US008123574B2

(12) United States Patent
Ma

(10) Patent No.: US 8,123,574 B2
(45) Date of Patent: Feb. 28, 2012

(54) CONTACT HAVING INCREASED RESILIENCE FOR USE WITH ELECTRICAL CONNECTOR

(75) Inventor: Hao-Yun Ma, Tu-Cheng (TW)

(73) Assignee: Hon Hai Precision Ind. Co. Ltd., New Taipei (TW)

( * ) Notice: Subject to any disclaimer, the term of this patent is extended or adjusted under 35 U.S.C. 154(b) by 78 days.

(21) Appl. No.: 12/690,832

(22) Filed: Jan. 20, 2010

(65) Prior Publication Data

US 2010/0184334 A1 Jul. 22, 2010

(30) Foreign Application Priority Data

Jan. 20, 2009 (TW) ..... 98201020

(51) Int. Cl.
*H01R 8/48* (2006.01)

(52) U.S. Cl. ..... 439/862

(58) Field of Classification Search ..... 439/862, 439/66, 71

See application file for complete search history.

(56) References Cited

U.S. PATENT DOCUMENTS 5,966,267 A * 10/1999 Hooley et al. ..... 360/97.01
6,083,059 A * 7/2000 Kuan ..... 439/862
6,190,193 B1 * 2/2001 Wagner ..... 439/336
6,200,151 B1 * 3/2001 Kaneko ..... 439/289
6,695,624 B1 2/2004 Szu
6,805,595 B2 * 10/2004 Kukita et al. ..... 439/862
6,814,586 B1 * 11/2004 Ju ..... 439/66
6,929,483 B2 8/2005 Huang
7,083,429 B2 * 8/2006 Hashimoto et al. ..... 439/71
7,150,658 B1 * 12/2006 Chien ..... 439/700
7,156,705 B2 * 1/2007 Soh ..... 439/862
7,445,518 B2 * 11/2008 Schneider nee Hild et al. ..... 439/700
7,497,744 B2 * 3/2009 Tsai ..... 439/862
2006/0035484 A1 * 2/2006 Hsu ..... 439/66
2008/0268675 A1 * 10/2008 Suzuki et al. ..... 439/82

* cited by examiner

*Primary Examiner* — Neil Abrams
(74) *Attorney, Agent, or Firm* — Andrew C. Cheng; Wei Te Chung; Ming Chieh Chang

(57) ABSTRACT

A contact adapted for electrically connecting with an IC package and a printed circuit board, comprises a base portion adapted for being retained to an insulating housing, a solder portion extending from a lower end of the base portion and a turned portion bent downwardly from one end of the base portion. The solder portion is adapted for soldering the contact to the printed circuit board. The contact further includes a resilient arm extending upwardly from a bottom end of the turned portion. The resilient arm has an inclined portion and a cantilever beam. The inclined portion is connecting with the turned portion. The cantilever extends upwardly from a top end of the inclined portion and toward the turned portion to lengthen the resilient arm of the contact. Housing cavities may be formed to cause pre-loading of the resilient arms as they are inserted into the cavities.

18 Claims, 7 Drawing Sheets

CONTACT HAVING INCREASED RESILIENCE FOR USE WITH ELECTRICAL CONNECTOR

BACKGROUND OF THE INVENTION

1. Field of the Invention

The present invention relates to a contact for an electrical connector, and more particularly to such a contact with increased elasticity to provide a desired resilient compliance for electrically connecting an IC package and a printed circuit board.

2. Description of Prior Art

With the trend of miniaturization in computer technology, the electrical connectors with an insulating housing and a plurality of terminals becomes smaller and smaller. Due to their miniaturized dimension, the terminals, especially mating beams of the terminals are easily damaged because of stress overly exerted thereon when the terminals engage with pins of a complementary electronic package, such as an IC package. Several measurements are proposed to solve this problem. For example, as that disclosed in U.S. Pat. No. 6,929,483 issued to Huang on Aug. 16, 2005, and U.S. Pat. No. 6,695,624 issued to Szu on Feb. 24, 2004, is to modify the configuration of the terminals so as to obtain optimal electrical and mechanical performance of the mating beams of the terminals.

As disclosed in U.S. Pat. No. 6,695,624 issued to Szu on Feb. 24, 2004, an electrical connector is used for electrically connecting an IC package and a printed circuit board. The electrical connector includes a base defining a surface and a number of passageways, and a number of contacts. Each contact comprises an engaging portion for engaging with the passageway, a medial portion extending upwardly from an end of the engaging portion, a solder portion extending perpendicularly from an opposite end of the engaging portion, an inclined portion extending aslant from the medial portion, and a cantilever extending from the inclined portion. The inclined portion and the medial portion form a connecting portion having a first line therebetween. The first line forms an angle relative to the surface of the base. The inclined portion and the cantilever portion form another connecting portion therebetween having a second line, the second line forming another angle relative to the surface of the base. A contact portion is defined on an upper end of the cantilever. Thus, the length of the mating arm is long enough to be deformable and compliance to touch a pad of the IC package mounted on the electrical connector in order to ensure reliable electrical connection between the electrical connector and the IC package. However, the contact portions of the contacts are easy to slide out the pads of the IC package because of overly exerted stress when the IC package is mounted on the electrical connector. If that happens, the electrical connector can not work normally.

Hence, an improved contact for an electrical connector is required to overcome the disadvantages of the prior art.

BRIEF SUMMARY OF THE INVENTION

An object of the present invention is to provide a contact for an electrical connector, wherein the contact has an increased elasticity to provide a good performance for electrically connecting an IC package and a printed circuit board.

To fulfill the above-mentioned object, a contact adapted for electrically connecting with an IC package and a printed circuit board, comprises a base portion adapted for being retained to an insulating housing, a solder portion extending from a lower end of the base portion and a turned portion bent downwardly from one end of the base portion. The solder portion is adapted for soldering the contact to the printed circuit board. The contact further includes a resilient arm extending upwardly from a bottom end of the turned portion. The resilient arm has an inclined portion and a cantilever beam. The inclined portion is connecting with the turned portion. The cantilever extends upwardly from a top end of the inclined portion and toward the turned portion to lengthen the resilient arm of the contact.

Other objects, advantages and novel features of the invention will become more apparent from the following detailed description of the present embodiment when taken in conjunction with the accompanying drawings.

DETAILED DESCRIPTION OF THE INVENTION

Figure 1:
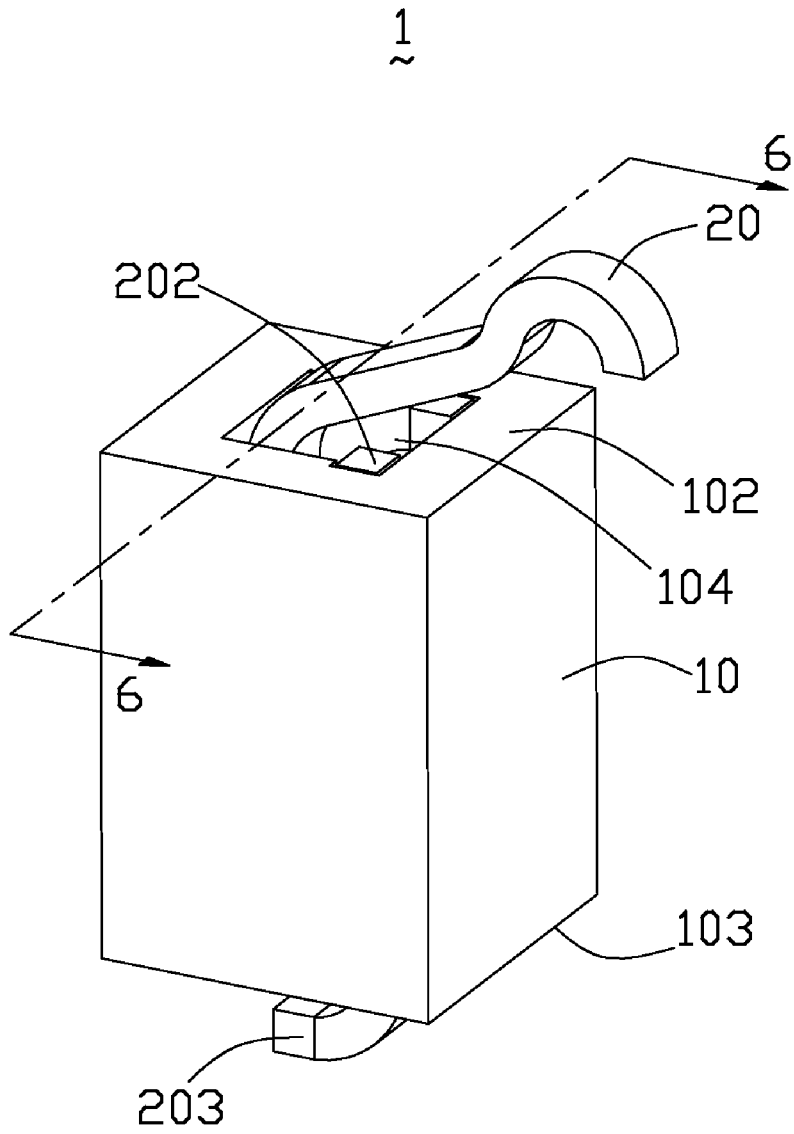
FIG. 1 is an assembled, perspective view of an electrical connector in accordance with a preferred embodiment of present invention.

Reference will now be made to the drawings to describe the present invention in detail.

Referring to FIGS. 1 to 7, there shows a perspective view of an electrical connector 1 used for electrically connecting an IC package 3 with a printed circuit board 4 incorporating inventive features of the present invention. The electrical connector 1 includes an insulative housing 10 and a plurality of contacts 20 received in the insulative housing 10.

Figure 2:
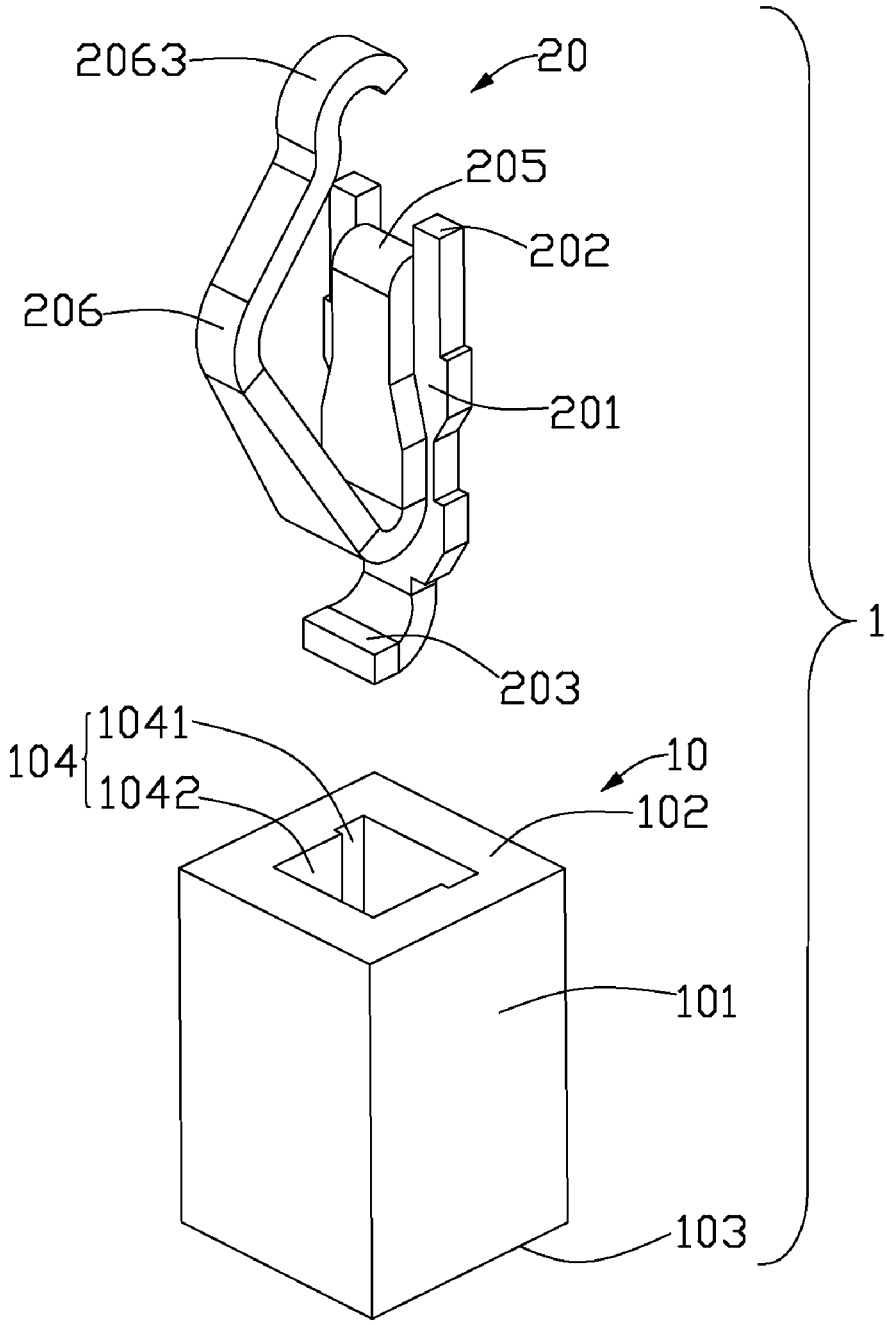
FIG. 2 is an exploded, perspective view of the electrical connector shown in FIG. 1.
Figure 3:
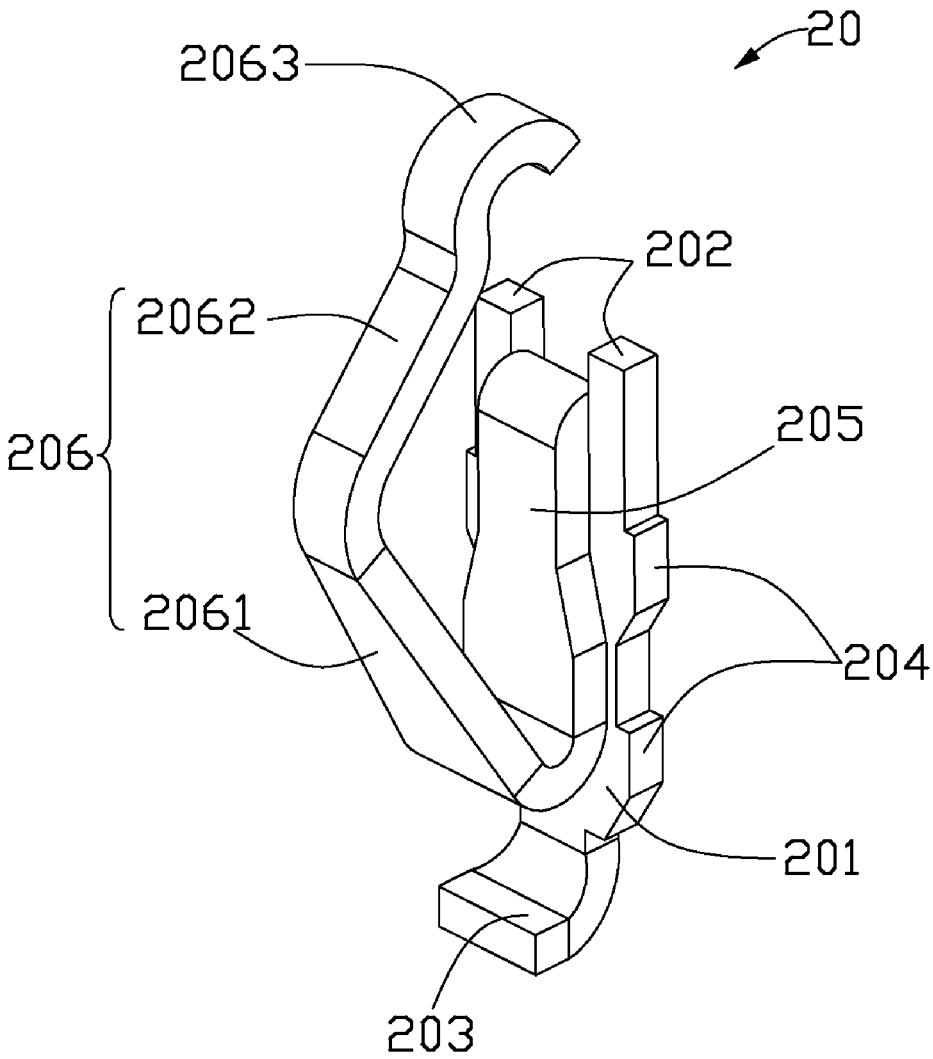
FIG. 3 is a perspective view of a contact of the electrical connector in accordance with the preferred embodiment of present invention.
Figure 4:
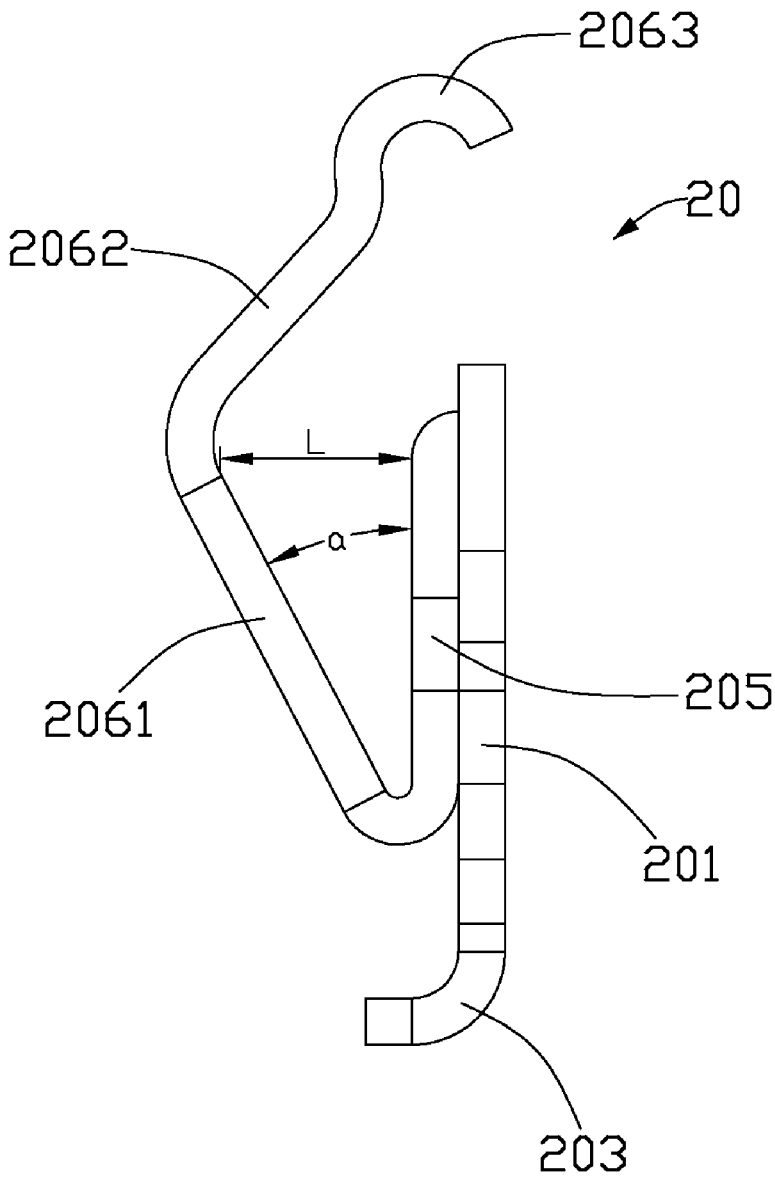
FIG. 4 is a side view of the contact after being assembled in an insulative housing, but the insulative housing is not shown.
Figure 5:
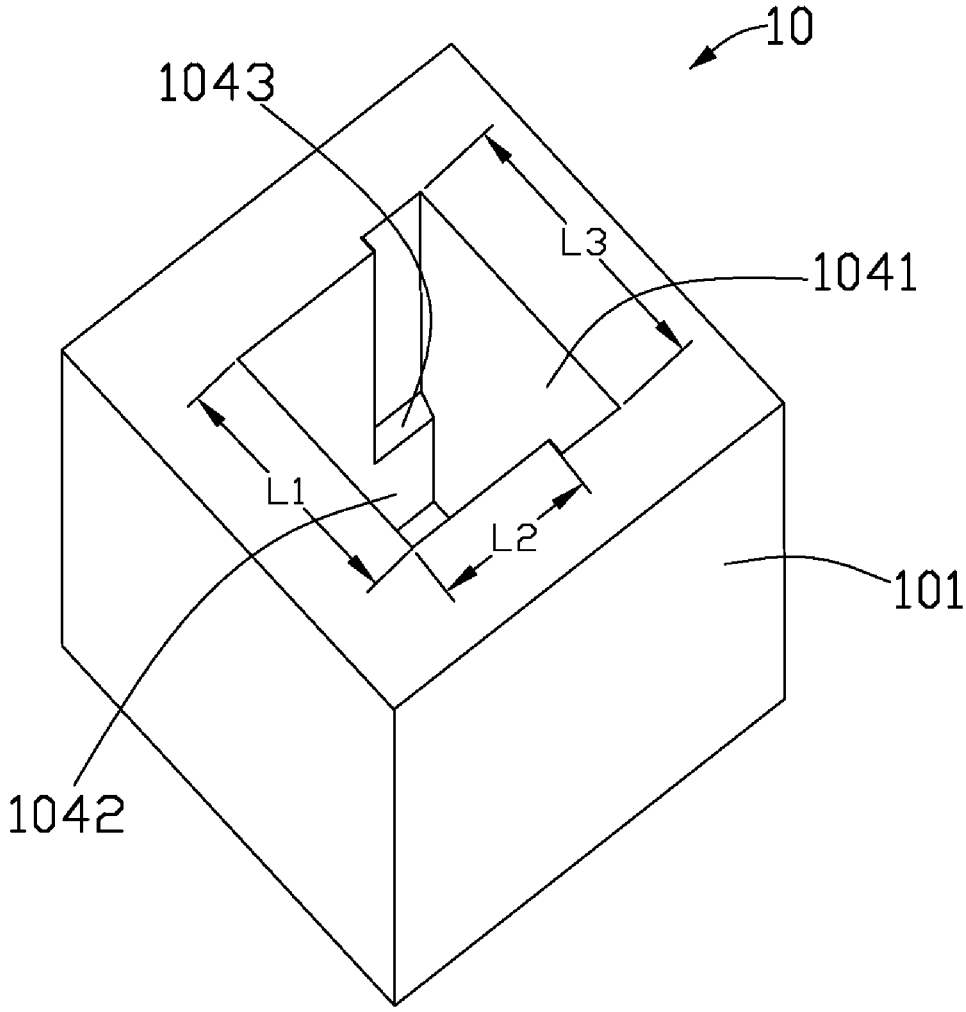
FIG. 5 is a perspective view of the insulative housing of the electrical connector in accordance with the preferred embodiment of present invention.
Figure 6:
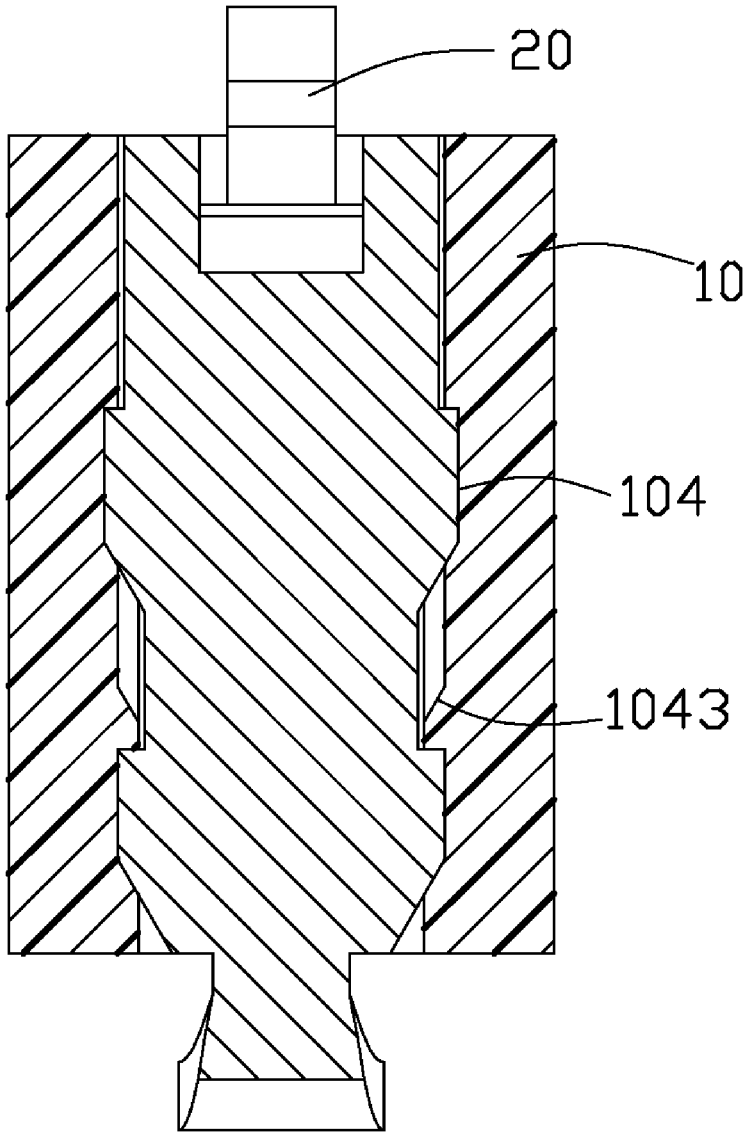
FIG. 6 is a cross-sectional view of the electrical connector of FIG. 1 taken along line VI-VI of FIG. 1.

As shown in FIGS. 2 and 3, the contact 20 includes a plate-like base portion 201, a pair of projecting portions 202 provided continuously at one end of the base portion 201 to extend in a direction substantially same as the base portion 201, a turned portion 205 provided continuously at the end of the base portion 201 and bent downwardly to face the base portion 201. The turned portion 205 is located between the pair of projecting portions 202 and extends downwardly aligned with a bottom end of the base portion 201. The turned portion 205 faces against to the base portion 201. The base portion 201 forms a plurality of barbs 204 at opposite sides thereof for retaining the terminal 20 to the insulting housing 10 of the electrical connector 1. A solder portion 203 extends perpendicularly from an opposite end of the base portion 201. The solder portion 203 can connect with a solder ball 5 for soldering the contact 20 on a pad 40 of the printed circuit 4.

A resilient arm 206 extends upwardly from a bottom end of the turned portion 205 of the contact 20. The resilient arm 206 includes an inclined portion 2061 connecting with the turned portion 205 and a cantilever beam 2062 extending upwardly from a top end of the inclined portion 2061. An acute angle α is formed between the inclined portion 2061 of the resilient arm 206 and the turned portion 205. The cantilever beam 2062 extends toward the projecting portions 202. The inclined portion 2061 is approximately in a tapered shape and is tapered off from its lower end to its upper end. The cantilever beam 2062 is narrower than the inclined portion 2061 so as to increase an elasticity of the whole resilient arm 206. An arc contact portion 2063 is formed on an upper end of the cantilever beam 2062 to conductively contact a corresponding conductive point 30 formed on the IC package 3 when the IC package 3 presses the arc contact portion 2063 downwardly.

The insulative housing 10 has a substantially rectangular shape, and includes a base 101 defining a mating surface 102 and a mounting surface 103. A plurality through slots 104 extend between the mating surface 102 and the mounting surface 103 of the base 101. The through slot 104 includes a first hole 1041 and a second hole 1041 connecting with the first hole 1041. A length of the first hole 1041 at a longitudinal direction is L1, a length of the second hole 1042 at the longitudinal direction is L3, and L3 is longer than the L1. The first hole 1041 is used to receive the base portion 201 of the contact 20. A plurality of protrusions 1043 extend from inner walls of the first holes 1041 for engaging with the barbs 204 of the contacts 20 so as to retain the contact 20 in the through slots 104 of the insulative housing 10. A length of the second hole 1042 at a transverse direction is L2, the biggest distance between the inclined portion 2061 and the turned portion 205 is L, and L2 is shorter than L.

Figure 7:
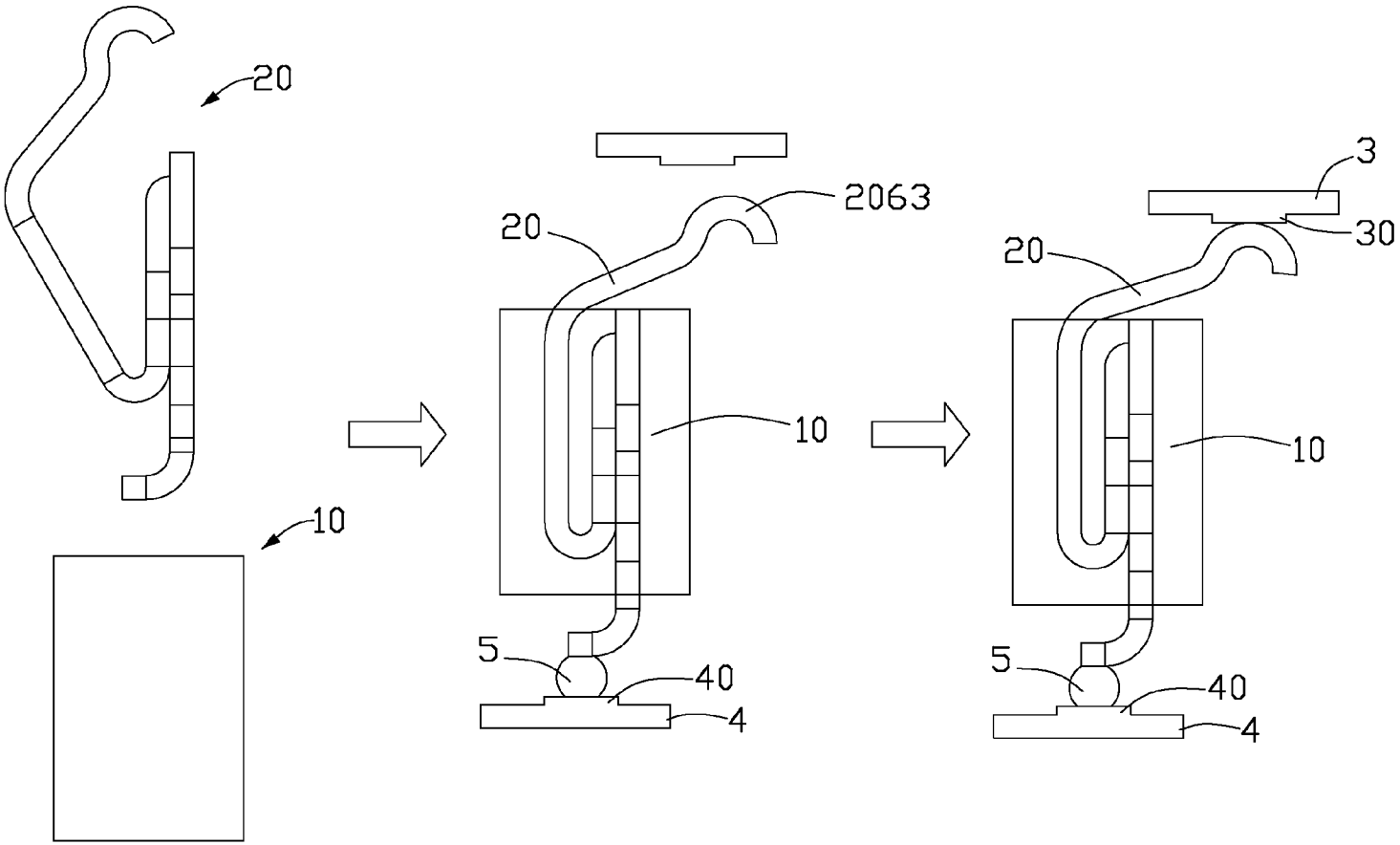
FIG. 7 is a perspective view of the electrical connector, showing the contact before being assembled in the insulative housing and the electrical connector electrically connecting an IC package and a printed circuit board.

Referring to FIG. 7, when the contact 20 is received in the through slot 104 of the insulative housing 10, the base 201 is retained in the first hole 2041 with the barbs 204, and the resilient arm 206 abuts against inner wall of the second hole 1042. And the cantilever beam 2062 of the contact 20 moves a certain distance closer to the turned portion 205 because of limitation of the inner wall of the slot 104. When the IC package 3 is not mounted on the electrical connector 1, the inclined portion 2061 is substantially parallel to the turned portion 205 and forms a U shape together with the turned portion 205. But when the IC package 3 is driven downwardly by external force to press the contact 20, the cantilever beam 2062 further continues to deflect downwardly. Thus, the contact portion 2063 can electrically connect with the conductive point 30 of the IC package 3.

The contact 20 has the turned portion 205 extending downwardly from a top edge of the base portion 201 and the resilient arm 206 extending from a bottom edge of the turned portion 205 so that the resilient arm 206 of the contact 20 of the electrical connector 1 has an adequate length, and the cantilever beam 2062 can elastically touch with the IC package 3. Thus, it can ensure a reliable electrical connection between the IC package 3 and the printed circuit board 4. Additionally, when the contact 20 is received in the through slot 104 of the insulative housing 10, the resilient arm 206 can be pre-loaded by the inner wall of the through slot 204, the cantilever beam 2062 of the resilient arm 206 can deflect downwardly a certain distance and a height of the contact 20 become lower. So it can satisfy the miniaturized trend of the electrical connector 1. Finally, the cantilever beam 2062 of the contact 20 can be pre-loaded by the inner walls of the through slot 104. Thus it can avoid a wiping appearance caused by the contact portion 2063 of the contact 20 sliding excessively when the contact portion 2063 touches with the IC package 3. From an overview point, the preferable embodiment of the instant invention essentially discloses a contact having the solder tail section (203) exposed below the bottom face of the housing, a contacting section (2062, 2063) upwardly extending above the upper face of the housing, and a serpentine connection section (201, 205, 2061) linked between the tail section (203) and the contacting section (2062, 2063) and located in the slot (104) and compressible in a transverse direction wherein two outermost segments of said serpentine connection section (201, 205, 2062) abut against the housing in an upstanding manner.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact adapted for electrically connecting with an IC package and a printed circuit board, comprising:

a base portion adapted for being retained to an insulating housing;

a solder portion extending from a lower end of the base portion and adapted for soldering to the printed circuit board;

a turned portion bent downwardly from a top end of the base portion, and a resilient arm extending upwardly from a bottom end of the turned portion, the resilient arm having an inclined portion connecting with the turned portion and a cantilever beam extending upwardly from a top end of the inclined portion and toward the turned portion; wherein a pair of projecting portions are provided continuously from the top end of the base portion and extend in a direction substantially same as the base portion of the contact; and wherein the turned portion is located between the pair of projections.

2. The contact as claimed in claim 1, wherein the turned portion extends downwardly till to a position aligned with a bottom end of the base portion and faces against to the base portion.

3. The contact as claimed in claim 1, wherein the base portion forms a plurality of barbs on opposite sides thereof, adapted for engaging with the insulative housing.

4. The contact as claimed in claim 1, wherein an angle is defined between the inclined portion of the resilient arm and the turned portion of the contact.

5. The contact as claimed in claim 4, wherein the angle between the inclined portion and the turned portion is an acute angle.

6. The contact as claimed in claim 1, wherein the inclined portion is tapered off from its lower end to its upper end.

7. The contact as claimed in claim 1, wherein the cantilever beam is narrower than the inclined portion.

8. The contact as claimed in claim 1, wherein a contact portion is formed on an upper end of the cantilever adapted for electrically connecting with a corresponding point formed on the IC package.

9. An electrical connector for electrically connecting with an IC package and a printed circuit board, comprising:

an insulative housing including a base defining a mating surface and a mounting surface, the base having a plurality of through slots extending through the mating surface and the mounting surface; and a plurality of contacts inserted into the through slots;

each contact having a base portion retained to the through slot of the insulating housing, a turned portion bent downwardly from one end of the base portion, and a resilient arm extending upwardly from a bottom end of the turned portion; and wherein an acute angle is defined between the resilient arm and the turned portion wherein the resilient arm is pre-loaded to move in a horizontal direction as it is inserted into the through slots of the insulative housing.

10. The electrical connector as claimed in claim 9, wherein the resilient arm of the contact has an inclined portion connecting with the turned portion and a cantilever beam extending upwardly from a top end of the inclined portion and toward the turned portion.

11. The electrical connector as claimed in claim 10, wherein each through slot of the insulative housing includes a first hole for receiving the base portion of the contact and a second hole connecting with the first hole for receiving the resilient arm.

12. The electrical connector as claimed in claim 11, wherein the base portion of the contact forms a plurality of barbs on opposite sides thereof, and the insulative housing has a plurality of protrusions extending from inner walls of the first holes for engaging with the barbs so as to retain the contact in the insulative housing.

13. The electrical connector as claimed as claimed in claim 9, wherein a solder portion extends horizontally from a lower end of the base portion.

14. An electrical connector comprising:

an insulative housing defining a plurality of passageways upwardly extending in a vertical direction and communicating with an exterior through an upper face of the housing;

a plurality of contacts downwardly assembled into the corresponding passageways, respectively; and each of said contacts defining a tail section for mounting to a printed circuit board, a resilient cantilevered contacting section extending above the upper face for mechanical and electrical engagement with an electronic component, a connection section linked between the tail section and the contacting section and essentially located in the corresponding passageway; wherein said connection section defines thereof a serpentine configuration composed by a series of segments and compressible in a transverse direction perpendicular to said vertical direction; wherein said connection section originally extends in a large dimension along said transverse direction before the contact is downwardly inserted into the corresponding passageway while is compressed into a small dimension along said transverse direction by the housing after insertion into the corresponding passageway under condition that said series of segments closely confront one another in said transverse direction.

15. The electrical connector as claimed in claim 14, wherein two outermost segments of said connection section abut against the housing in an upstanding manner after the contact is fully inserted into the corresponding passageway.

16. The electrical connector as claimed in claim 15, wherein said connection section defines only three said segments including said two outermost segments and one middle segment therebetween.

17. The electrical connector as claimed in claim 16, wherein one of the two outermost segments linked to the contacting section is spaced from the middle segment with a tiny gap for providing superior resiliency to the contacting section while the other of said two outermost segments tightly abuts against the middle segment.

18. The electrical connector as claim 17, wherein said connection section includes a first joint section linked between lower ends of the middle segment and said one of the two outermost segments, and a second joint section linked between upper ends of the middle segment and the other of the two outermost segments.

* * * * *